US005356592A

United States Patent [19]

Balla et al.

[11] Patent Number: 5,356,592

[45] Date of Patent: Oct. 18, 1994

[54] METHOD OF STERILIZING A PACKAGING MATERIAL BY MEANS OF A STERILIZING AGENT IN LIQUID FORM

[75] Inventors: Gyula Balla, Malmö; Bo Berlin, Staffanstorp, both of Sweden

[73] Assignee: Tetra Laval Holdings & Finance SA, Pully, Switzerland

[21] Appl. No.: 978,077

[22] Filed: Nov. 18, 1992

Related U.S. Application Data

[63] Continuation of Ser. No. 782,304, Oct. 24, 1991, abandoned.

[30] Foreign Application Priority Data

Nov. 7, 1990 [SE] Sweden ..... 9003543

[51] Int. Cl.[5] ..... A61L 2/18; B08B 5/04; B08B 6/00

[52] U.S. Cl. ..... 422/28; 422/22; 422/23; 422/34; 239/708

[58] Field of Search ..... 422/21–23, 422/25, 28, 34; 239/3, 708; 15/1.51

[56] References Cited

U.S. PATENT DOCUMENTS

| | | | |
|---|---|---|---|
| 3,915,737 | 10/1975 | Sroka | 134/1 |
| 4,225,556 | 9/1980 | Löthman et al. | 422/28 |
| 4,281,431 | 8/1981 | Nierlich et al. | 15/1.5 R |
| 4,366,125 | 12/1982 | Kodera et al. | 422/24 |
| 4,454,621 | 6/1984 | Testone | 15/1.51 |
| 4,511,538 | 4/1985 | Buchner et al. | 422/29 |
| 4,537,007 | 8/1985 | Lattanzi | 53/425 |
| 4,680,163 | 7/1987 | Blidschun et al. | 422/28 |
| 4,900,527 | 2/1990 | Lierke | 422/302 |
| 5,008,076 | 4/1991 | Johansson et al. | 422/28 |
| 5,008,968 | 4/1991 | Preston | 15/1.51 |
| 5,069,017 | 12/1991 | Fabricius | 422/24 |

*Primary Examiner*—Robert J. Warden
*Assistant Examiner*—Krisanne M. Thornton
*Attorney, Agent, or Firm*—Burns, Doane, Swecker & Mathis

[57] ABSTRACT

Method of sterilizing a packaging material with a sterilizing agent in liquid form. The packaging material is discharged in order to eliminate electrostatic surface charged on the packaging material, after which the packaging material is wetted with the sterilizing agent which is applied in an electrostatically charged form to those areas of the packaging material which are to be sterilized. The packaging material with the sterilizing agent, which coalesces to a thin, homogeneous film, is finally heated to drive away the sterilizing agent from the sterilized packaging material.

13 Claims, 1 Drawing Sheet

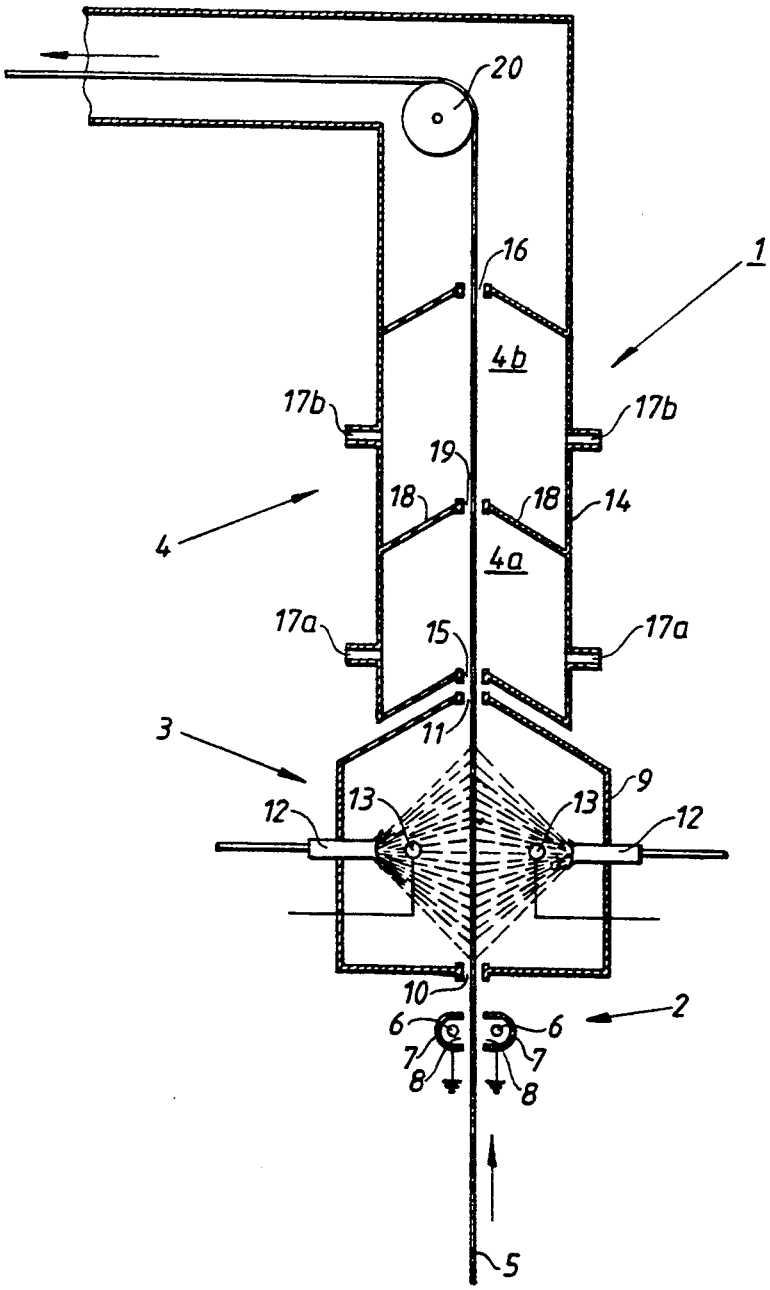
20
16
1
4b
17b
17b
19
18
18
14
4
4a
17a
15
17a
3
11
9
13
13
12
12
10
2
6
6
7
7
8
8
5

METHOD OF STERILIZING A PACKAGING MATERIAL BY MEANS OF A STERILIZING AGENT IN LIQUID FORM

This application is a continuation, of application Ser. No. 07/782,304, filed Oct. 24, 1991 now abandoned.

BACKGROUND AND SUMMARY OF THE INVENTION

The present invention concerns a method of sterilizing a packaging material by means of a sterilizing agent in liquid form.

Aseptic packaging technology has for a long time been used for packaging foodstuffs and the like, especially products sensitive to bacteria and storage, in order to give the product an extended life so that it can be kept with retained fresh qualities for longer periods of time from the day of packaging without risk of it being spoiled or deteriorating. The technology which is well known to the specialist in the area can for example start out from the fact that the product and the packaging material are each subjected to a sterilizing treatment for the purpose of neutralizing harmful micro-organisms occurring in the product or the packaging material, in particular pathogenic bacteria, and that the treated product is thereafter enclosed in the sterilized packaging material under sterile conditions in order to avoid a bacterial reinfection of the sterilized product.

Aseptic packagings for milk, juice and similar liquid foods are now most frequently produced with the aid of modern, rational packaging machines of the type which, from a strip or sheet of plastic coated paper or cardboard material, forms, fills and closes packagings under aseptic conditions. From, for example, a strip a known packaging machine produces aseptic packagings for milk through the strip being taken for the purpose of serialization through a bath containing 10–35% by weight of hydrogen peroxide within a chamber essentially completely screened from the environment (what is known as an aseptic house). After the passage through the bath the strip is taken through the pinching between press rollers in order to remove the surplus sterilizing agent from the strip and take it back to the bath, after which the strip, without coming into contact with the machine environment is taken into the forming and filling chamber of the machine which is likewise essentially completely screened from the environment. The strip is shaped into a tube through the two longitudinal edges of the strip being joined to each other in a longitudinal overlap joint at the same time as the packaging material in the tube formed is heated by means of sterile hot air in order to vaporize and drive away the residue of accompanying sterilizing agent from the packaging material. The tube is filled with the appropriate previously sterilised contents, heat treated milk, which is fed to the tube through a filler pipe opening into the tube, and separated into closed, filled packagings through repeated transverse sealings of the tube across the longitudinal axis of the tube. The packagings are separated from each other through cuts in the transverse seals and are subsequently given the desired geometric final shape, usually of parallelpiped type, before outfeed of the finished aseptic packagings from the machine. During the whole process an overpressure of sterile hot air is maintained in the shaping and filling chamber in order to prevent unsterile environmental air penetrating and reinfecting the sterilized contents and the packaging material.

A precondition for achieving good serialization of the packaging material in the above described known method is that the whole strip, after passing through the sterilizing bath, is covered by a coherent film of sterilizing agent in order to ensure that all parts of the packaging material are effectively sterilized. The film should in addition preferably be thin and of even thickness in order to facilitate and make more effective the subsequent driving away of the stabilizing agent in the shaping and filling chamber. These two conditions have been shown to be difficult to fulfill in practice and it not infrequently happens that the sterilizing agent exhibits an irregular film distribution over the strip surface with alternating thicker and thinner film zones, which not only leads to an uneven, unpredictable sterilization effect but also makes the drying process more difficult during heating. It sometimes also happens that the sterilizing agent is completely missing along certain areas, while other areas of the strip show island-like concentrations of the sterilizing agent, which thus further worsens the possibility of achieving the intended even serialization effect over the whole strip. Another disadvantage with the above described and other known methods which employ a bath of sterilizing agent through which the strip is taken is what is called the edge suction phenomenon which entails that the exposed fibrous material in the longitudinal cut edges easily absorb the sterilizing agent in liquid form which is sucked into and retained in the fibrous layer of the strip and finally accompanies the packaging material into the finished packaging. Since the inward facing cut edges in the finished packaging are always well protected no risk occurs that the accompanying sterilizing agent should come in contact with and affect the contents of the packaging, but on the contrary the risk is great that the liquid absorbed will at least locally cause deterioration in the rigidity and stability of form of the packaging at the same time as it of course entails an unnecessary loss of sterilizing agent.

The aim of the present invention is therefore to give indications about a new way of sterilizing a packaging material by means of a sterilizing agent in liquid form without subsequent problems of the type described above.

This aim is achieved according to the invention through the fact that a method of the type described in the introduction is given the characteristics that the packaging material is first discharged in order to eliminate electrostatic surface charges occurring on the strip, that the sterilizing fluid is subsequently applied to the packaging material in a finely distributed, electrostatically charged form to create a coherent, homogeneous film, and that the packaging material is finally heated to drive away the sterilizing fluid from the ready sterilised packaging material.

Through first eliminating the surface charges on the packaging material and thereafter applying the sterilizing agent form in a finely distributed, electrostatically charged form it has been shown that the finely distributed sterilizing agent is not only easily received on the packaging material but in addition it easily coalesces without hindrance from inhibiting electrostatic repulsion forces and forms a homogeneous film completely covering the packaging material with the same good predictable sterilizing effect. A further advantage which is gained through the process according to the invention is that the film applied can be made very thin, but of even thickness, which considerably facilitates the subsequent heating of the strip to drive away the sterilizing agent. Furthermore the problem with edge suction is completely avoided since the cut edges of the strip do not need to come in contact with the sterilizing agent.

Further advantageous and practical embodiments of the method according to the invention have further been given the characteristics mentioned in the sub-claims below.

BRIEF DESCRIPTION OF THE DRAWINGS

The invention will be described in greater detail below with reference to the enclosed drawing in which FIG. 1 is a cross-sectional view of an apparatus according to an embodiment of the present invention.

DETAILED DESCRIPTION

In the drawing what is called an aseptic house with the general reference designation 1 is shown, situated before the forming and filling chamber (not shown) in a packaging machine of the type described previously. The aseptic house 1 comprises a discharging station 2, a sterilizing chamber 3 and a drying chamber 4 through which a strip 5 of plastic coated paper or cardboard material is intended to be taken for serialization of the packaging material before forming into finished aseptic packagings in the subsequent forming and filling chamber.

The discharging station 2 contains two or more ionizer electrodes 6 located in pairs on both sides of the strip 5 and centrally placed in an area 8 delimited by a semicircular, grounded screen 7. Screens 7 facing each other in each such pair of screens have their open sides turned towards each other to form a narrow gap or passage through which the strip 5 is intended to be taken in order to eliminate electrostatic surface charges occurring on both sides of the strip.

The sterilizing chamber 3 is delimited by a casing 9 with inlet 10 and outlet 11 for the strip 5. On opposite sides in the direction of travel of the strip through the chamber 3 there are squirting or spraying devices 12 placed in the middle facing each other, e.g. spray guns, which are arranged to spray a jet of finely distributed sterilizing agent towards the two sides of the strip as it passes by, in such a way that the strip is hit over its whole width and wetted by the jets. Between the respective devices 12 there is a high-tension electrode 13 which is arranged to charge the finely distributed sterilizing agent electrostatically before contact with the strip. Even though the high-tension electrode 13 is shown as a separate unit in front of the device 12, it is obvious to the specialist that the electrode 13 can be fitted inside or form part of the device 12.

The drying chamber 4 is delimited by a casing 14 with inlet and outlet 15 and 16 respectively for the strip 5 and also inlets 17*a* and 17*b* for sterile hot air which, after passing through the drying chamber 4, accompanies the strip out of the chamber through the outlet 16. The drying chamber 4 is divided into two part-chambers, a lower one 4*a* and an upper one 4*b*, with the aid of two obliquely placed screens or plates 18 placed at the same level opposite each other. The screens or plates 18 form between them a narrow passage 19 for the strip 5 and sterile air, fed through the lower inlet 17*a* into the part-chamber 4*a*, which is directed through it and forced to a high speed of flow in effective contact with the strip 5.

In sterilization with the aid of the device 1 shown one proceeds in the following manner according to the invention. The strip 5 is unrolled from a feed roller which is not shown and is taken through the gap between the semicircular screens 7 situated on each side of the strip at the same time as the electrodes 6 are activated for ionization of the air in the delimited spaces 8 open towards the strip. The thus ionized, electrically conducting air thereby comes to neutralize or discharge electrostatic surface charges occurring on both sides of the strip, whereby the strip, after passing between the ionizer electrodes 6, is practically entirely electrically discharged and exhibits an electric potential corresponding to earth potential (0 potential). The discharged strip is taken into the sterilizing chamber 3 through the inlet 10 and passes between the two opposite facing spraying or squirting devices 12 which spray finely distributed sterilizing agent electrostatically charged with the aid of the high-tension electrodes 13 against both sides of the strip as it passes by. The sterilizing agent in its liquid form may be a 10–35% solution of hydrogen peroxide. The charged, finely distributed sterilizing agent is absorbed on the discharged strip and coalesces without hindrance from electrostatic repulsion forces to form a homogeneous film, completely covering both sides of the strip. The strip is taken via outlet 11 into the drying chamber 4 through the inlet 15 at the same time as hot air is fed to the lower part-chamber 4*a* through the inlet 17*a* in order to drive away the sterilizing agent from the strip. Through the gap 19 the strip is taken further into the upper part-chamber 4*b* at the same time as further sterile hot air is brought in through the inlet 17*b* for final drying of the strip. After passing through the chamber 4 the sterilized, dried strip 5 is taken together with the air out through the outlet 16 at the upper end of the chamber and further via a break roller 20 into the machine's forming and filling station for forming into finished aseptic packagings.

By the method according to the invention it is thus possible to achieve a good, even sterilizing effect with the use of a sterilizing agent in liquid form, without subsequent problems of the type connected with the previously described known technology. A considerable advantage is that with the method according to the invention it is possible accurately to regulate the amount or thickness of the film of liquid applied to the strip and in particular it has been shown to be possible to apply the sterilizing agent in liquid form as a very thin but coherent film of even thickness which considerably improves and makes more effective the subsequent heating which can thereby be regulated and optimized.

Even though the invention has been described with special reference to the embodiment shown it should be observed that for the specialist close modifications are of course possible without going away from the concept of the invention as this is defined by the sub-claims below. For example the heating for driving away the film of sterilizing agent from the strip can be carried out in a different way from the one which is particularly described, e.g. with the aid of IR, microwaves, HF (high frequency) etc if this for one reason or another should prove to be more advantageous than using hot sterile air. Further it is possible according to the invention to optimize the driving away of the sterilizing agent through regulating the heating, whether it is done with hot air or in another manner, depending on temperature or moisture content found near the packaging material, which further contributes to improving the economy in carrying out the method, without the good sterilizing effect being lost or deteriorating.

While this invention has been illustrated and described in accordance with a preferred embodiment, it is recognized that variations and changes may be made therein without departing from the invention as set forth in the claims.

What is claimed is:

1. A method of sterilizing a packaging material having two sides with a sterilizing agent in liquid form, comprising the steps of:

ionizing air on both sides of the packaging material;

discharging, to ground potential, both sides of the packaging material to eliminate electrostatic surface charges occurring thereon in the ionized air on both sides of the packaging material;

applying the agent to both sides of the discharged packaging material in an electrostatically charged spray to form a coherent, homogeneous film on the packaging material, the electrostatically charged spray being formed by directing jets of the agent from spraying means past high-tension electrodes placed between the spraying means and the packaging material; and heating the packaging material to drive away the agent from the sterilized packaging material.

2. The method according to claim 1, wherein the air is ionized by one or more ionizer electrodes.

3. The method according to claim 1, comprising the further step of regulating the heating of the packaging material for driving away the sterilizing agent in liquid form as a function of air temperature adjacent at least one of the sides of the packaging material.

4. The method according to claim 1, wherein the packaging material is heated by means selected from the group consisting of IR, microwaves, HF and hot air which is brought into contact with the packaging material.

5. The method according to claim 1, wherein the sterilizing agent in liquid form is a 10–35% solution of hydrogen peroxide.

6. The method according to claim 1, comprising the further step of regulating the heating of the material for driving away the sterilizing agent in liquid form as a function of moisture content of the air adjacent to at least one of the sides of the packaging material.

7. The method according to claim 1, comprising the further step of regulating the heating of the packaging material for driving away the sterilizing agent in liquid form as a function of temperature content of the air adjacent to at least one of the sides of the packaging material.

8. The method according to claim 1, wherein the means for spraying comprise one or more spray guns.

9. A method of sterilizing a packaging material web having opposite sides, comprising the steps of:

drawing the packaging material web between a pair of ionizer electrodes in a first area;

discharging electrostatic surface charges on the opposite sides of the packaging material web in air ionized by the ionizer electrodes such that the packaging material web is at ground potential;

forming a sterilizing agent spray on the opposite sides of the packaging material web;

electrostatically charging each of the sterilizing agent sprays in a second area;

applying the sterilizing agent spray to the opposite sides of the packaging material web such that the sterilizing agent spray forms a film on both sides of the packaging material web; and heating the packaging material web to evaporate the film from the packaging material web.

10. The method according to claim 9, comprising the further step of regulating the heating of the packaging material web as a function of air temperature adjacent at least one of the sides of the packaging material web.

11. The method according to claim 9, comprising the further step of regulating the heating of the packaging material web as a function of moisture content of the air at least one of the sides of the packaging material web.

12. A method for sterilizing a packaging material web, comprising the steps of:

advancing a web vertically through a housing between a first location and a second location;

electrically discharging the web before the web passes the first location;

spraying electrostatically charged sterilizing agent on opposite sides of the discharged web in a spraying zone in the housing;

directing a first stream of hot air against opposite sides of the web in a first chamber and directing a second stream of hot air against opposite sides of the web in a second chamber, said first and second chambers being spaced apart longitudinally of the direction of advance of the web; and the first and second chambers being between the spraying zone and the second location whereby the web passes sequentially through locations where the surfaces of the web are electrically discharged, sprayed with a sterilizing agent, and dried with hot air.

13. The method according to claim 12, wherein the electrical discharging step includes ionizing air adjacent opposite sides of the web.

* * * * *